United States Patent [19]

Fischer

[11] 4,310,753

[45] Jan. 12, 1982

[54] KEY FOR DATA PROCESSING MINIATURE IMPLEMENTS

[76] Inventor: Janos Fischer, Feldblumenweg 22, Zurich, Switzerland

[21] Appl. No.: 112,311

[22] PCT Filed: Oct. 6, 1978

[86] PCT No.: PCT/CH78/00027

§ 371 Date: Jun. 13, 1979

§ 102(e) Date: Jun. 13, 1979

[87] PCT Pub. No.: WO79/00203

PCT Pub. Date: Apr. 19, 1979

[30] Foreign Application Priority Data

Oct. 13, 1977 [DE] Fed. Rep. of Germany ..... 2731690

[51] Int. Cl.[3] ..... G06C 7/02

[52] U.S. Cl. ..... 235/145 R

[58] Field of Search ..... 235/145 R, 127, 145 A, 235/146; 200/5 A; 116/279, DIG. 28; 400/490; 234/123

[56] References Cited

U.S. PATENT DOCUMENTS 2,117,398 5/1938 Brown, Jr. ..... 235/127 X 2,484,886 10/1949 Henry ..... 400/490

4,120,039 10/1978 Fischer ..... 200/5 A X 4,128,889 12/1978 Ojima et al. ..... 200/5 A X

OTHER PUBLICATIONS

IBM Technical Disclosure Bulletin "Optical Key Board" by J. J. Sharp et al., vol. 5, No. 10, Mar. 1963, p. 127.

*Primary Examiner*—L. T. Hix

*Assistant Examiner*—Benjamin R. Fuller

*Attorney, Agent, or Firm*—Watson, Cole, Grindle & Watson

[57] ABSTRACT

Keys which are used in a keyboard of a miniaturized data processing device include an upper surface which is provided with a downwardly-extending wall running transversely to the movement of the finger when operating the keys. The downwardly-extending wall, which is formed, for example, by a groove disposed in the upper surface, serves as a support for the tip of a user's fingernail when operating the keys. Such keys make possible an accurate operation even if the keys are disposed closely side by side in a miniaturized key board and the fingernail is fashionably long.

12 Claims, 11 Drawing Figures

KEY FOR DATA PROCESSING MINIATURE IMPLEMENTS

BACKGROUND OF THE INVENTION

The invention relates to keys in a keyboard of a data processing device, especially in wrist watch format, wherein the miniaturized keys are disposed closely side by side.

Electronic minicomputers, which frequently are combined with electronic watches in wrist watch size, contain miniaturized keys of, for example, 1 mm diameter, which are operated by means of an operating pin; for this purpose, the upper surfaces of the keys are formed to have a concave shape. As against the considerable advantage that, for example, a wrist watch computer is always available within easy reach, its operation by means of a pin is not generally considered to be very much of a disadvantage, since the computer is used mostly in situations where, if not the original pin itself, some replacement tool will be always available. In order to be able to use such a wrist watch calculator in those rather rare situations where neither the separate operating pin nor a replacement pin is handy, the proposal had already been made to provide on the housing a releasable operating device, for example, in the form of a closing element for the housing lid (German OS No. 25 02 583). In such an embodiment, the minicomputer may thus generally be operated in the easiest manner by means of a pin-shaped replacement device, and only in exceptional instances will the cumbersome removal of the operating device disposed on the housing be necessary. If, for example, the electronic wrist watch is combined with some other data processing device, such as for example, with a telephone register, then conditions are just the reverse, i.e., the telephone register generally is used in situations in which no pin-shaped replacement instrument is available, so that the cumbersome removal of the operating instrument from the housing becomes the rule. In such cases an operation of the keyboard with an operating pin is felt to be too cumbersome and annoying. The necessity of having to use a pin-shaped instrument for a safe operation of the keys of a miniaturized keyboard is, therefore, a disadvantage of such known keyboards, which, depending on the circumstances, is more or less serious, and in any case it always exists.

It is the task of the present invention to create a key for the keyboards, particularly keyboards of data processing miniature devices, wherein its safe operation is not tied to the use of a pin-shaped operating instrument.

SUMMARY OF THE INVENTION

According to the invention, the upper surface of the key has at least one concave or straight supporting wall for the support of the tip of the user's finger nails, the supporting wall running transversely to the movement of the user's fingers when operating the keys. Keyboards with such keys may first of all be operated easily and safely even by individuals with fashionable, long fingernails, independent of the size of and partition between the keys. In addition, it will be possible to operate large keys of the new keyboard also with the tip of the finger and miniaturized keys also with any optional instrument, so that especially in case of keyboards of subminiature devices, the range of simple, uncomplicated, accurately aimed operation is considerably expanded compared with the known keyboards.

The supporting wall may be the front lateral wall of a groove in the direction of the movement of the finger, with an essentially V-shaped cross section, as a result of which correct placing of the tip of the fingernail for an accurate operation of the key will be assured. The front side of the groove may also be undercut, so that the supporting wall slopes downwardly in the direction of the movement of the finger. In order to assure an accurate placement even of a pointed operating instrument, for example, of a needle, then, in case of a groove curved in the direction of the movement of the finger, its width of opening may decrease from the middle to one of its ends, or to both its ends, so that the operating instrument may not slip off laterally, and, moreover, the key in the front area, adjoining the upper edge of the supporting wall, may be higher than in the rearward area, adjoining the upper edge of the other side of the groove, whereby the forward area of the front side of the key may be convex in shape and the rearward area of the front side of the key concave in shape.

In the following paragraphs, the invention will be explained in more detail on the basis of embodiments with reference to the attached drawing.

DETAILED DESCRIPTION OF THE PREFERRED EMBODIMENTS

Figure 1:
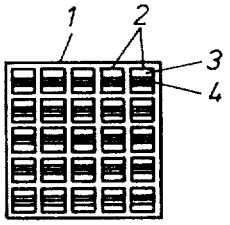
FIG. 1 is a top view of a keyboard with 5×5 keys according to the invention.
Figure 2:
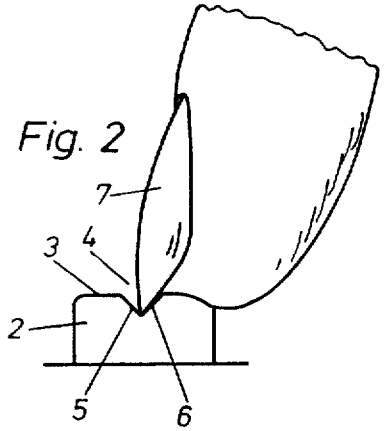
FIG. 2 shows in side view a key of the keyboard of FIG. 1 being operated by a fingernail.

The keyboard 1 shown by way of example in FIG. 1 contains 5×5 square keys 2, which are arranged in lines and rows, lying closely side by side. Each key contains in its upper surface 3 a groove 4, into which a fingernail may be inserted, running transversely of the key (i.e. with respect to the direction of the movement of the user's finger) for cooperation with the user's fingernail. In FIG. 2 a key 2 of the keyboard 1 of FIG. 1 is shown schematically in side view on an enlarged scale, while being operated by the fingernail 7. In its upper surface 3 the key 2 has a straight groove 4 with V-shaped cross section, of which the wall 5 of the groove, i.e. lying forward in the direction of the finger movement, constitutes a supporting wall for the fingernail 7 and the wall 6 of the groove (lying rearwardly in the direction of movement) constitutes a guide when inserting the tip of the fingernail into groove 4. The key 2 may have any shape: square, as shown, or rectangular, round or oval, a.s.f. The size of the key is also optional, and also their mutual distance in the keyboard as well as their arrangement. Larger keys may also have several grooves on their front.

Figure 3:
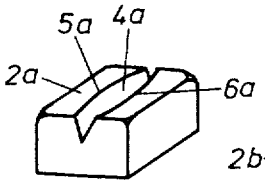
FIGS. 3 to 5 show three different embodiments in perspective presentation of cuboid-shaped keys according to the invention, always provided with a groove.

In case of the cube-shaped key 2*a*, shown in perspective presentation in FIG. 3, the forward groove-wall, i.e., the supporting wall 5*a* for the fingernail is convex in the direction of the finger movement and the rearward wall of the groove, i.e., the guide-wall 6a for the fingernail, is concave, so that the opening width of the groove 4a decreases from its middle toward the two ends of the groove, as a result of which an accurate operation of the keys with a pointed object is also assured, since the latter cannot slide off laterally the key.

Figure 4:
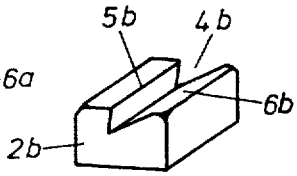

The cube-shaped key 2b, shown in FIG. 4, contains a straight groove 4b which forms with its forward groove-wall a steep supporting wall 5b for the tip of the fingernail, and with its rearward groove-wall a comparatively flat guide-wall 6b.

Figure 5:
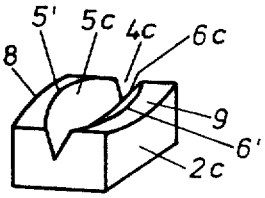

The cube-shaped key 2c, shown in FIG. 5, which on its front has a groove 4c, corresponds in its form to about the groove 4a, shown in FIG. 3, i.e., it forms a steep and convex supporting wall 5c with its foward groove-wall, and a steep and concave guide-wall 6c for the tip of the fingernail with its rearward groove-wall. The area of the front 8 of the key connecting with the forward top edge 5' of the groove, is curved upward, therefore convex, and the rear area of the front of the key, joining the rearward top edge 6' of the groove is curved downward, therefore concave. As a result, the supporting wall for the fingernail is enlarged in the middle of the key and the guide has been adapted better to the shape of the nail.

The straight or convex supporting wall may slant upwardly from the bottom of the groove in the direction of the movement of the finger or it may slant downwardly from the forward top edge 5' of the groove in the direction of the movement of the finger. In any case, the supporting wall is steep while the guide-wall may be flat to horizontal.

FIGS. 6 to 10 show cross sections of keys with different shapes of grooves.

Figure 6:
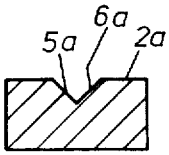
FIGS. 6 to 10 show cross sections of five different keys.
Figure 7:
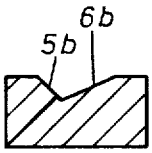
Figure 8:
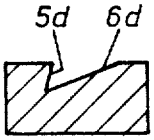
Figure 9:
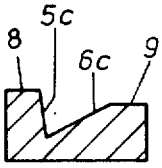
Figure 10:
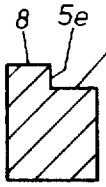

In case of the embodiment as in FIG. 6, which corresponds to a key 2 in FIG. 1 and to the key 2a in FIG. 3, the groove lies in a level front 2a of the key and its cross section has the shape of about a regular triangle, so that the guide wall 6a and the supporting wall 5a have about the same steepness. In case of the embodiment shown in FIG. 7, the supporting wall 5b has a steep slope, whereas the guide-wall 6b has a considerably lesser slope. The key of FIG. 5 has such a cross section. In the embodiment in FIG. 8, the guide-wall 6d slants slightly downwardly in the direction of the movement of the finger, and connects at its bottom to a steep supporting wall 5d, sloped backwardly. FIG. 9 shows a cross-sectional form as for example, of the key in FIG. 5. The first surface portion area of the upper surface of the key, designated by 8, is in a higher plane than the second surface portion 9. A key having a straight groove and planar surface portions 8, 9 can also have such a cross section. FIG. 10 shows a particularly simple variation of the embodiment with a perpendicular supporting wall 5e and a horizontal guide-wall 6e.

In case of the grooves, the supporting wall may be straight or convex. The guide-wall may be straight, less convex than the supporting wall, or it may be concave.

Figure 11:
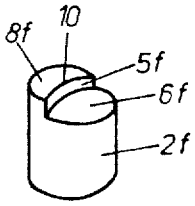
FIG. 11 shows a round key in an additional embodiment according to the invention in perspective presentation.

FIG. 11 shows, in an enlarged scale, an embodiment of a miniature round key. The key 2f has a step or a recess on its upper surface, which forms a perpendicular or convex supporting wall 5f slanting forward and downward from the upper edge 10. The first surface portion 8f is planar or curved upwardly cylindrically or else for example, in the form of a spherical sector. The second surface portion 6f is planar or arched downwards.

Keys with such shapes may easily be produced from plastic.

I claim:

1. In a miniaturized data processing data which includes a keyboard that utilizes miniaturized keys located in close side-by-side relationship, the improvement wherein at least one of the miniaturized keys of the keyboard includes an upper surface comprising a first surface portion, a second surface portion and a downwardly-extending wall located between said first surface portion and said second surface portion, said downwardly-extending wall extending transversely of the key from one side to the other and acting to support the tip of a user's fingernail.

2. The miniaturized data processing device of claim 1 wherein said device is a wristwatch.

3. The miniaturized data processing device of claim 2 wherein said downwardly-extending wall is convex in curvature with respect to the direction of movement of a user's fingernail along the upper surface of the key.

4. The miniaturized data processing device of claim 3 wherein said first surface portion merges with the top of said downwardly-extending convex wall and wherein said second surface portion merges with the bottom of said downwardly-extending convex wall.

5. The miniaturized data processing device of claim 3 including an upwardly-extending wall extending between the bottom of said downwardly-extending convex wall and said second surface portion.

6. The miniaturized data processing device of claim 5 wherein said upwardly-extending wall is convex in curvature with respect to the direction movement of a user's fingernail along the upper surface of the key.

7. The miniaturized data processing device of claim 2 wherein said downwardly-extending wall is planar.

8. The miniaturized data processing device of claim 7 including a planar upwardly-extending wall extending between the bottom of said downwardly-extending planar wall and said second surface portion.

9. The miniaturized data processing device of claim 8 wherein said downwardly-extending planar wall and said upwardly-extending planar wall form a generally V-shaped cross section.

10. The miniaturized data processing device of claim 8 wherein the upward angle of inclination of said upwardly-extending planar wall is less than that of said downwardly-extending planar wall.

11. The miniaturized data processing device of claim 10 wherein said second surface portion lies in a lower plane than said first surface portion.

12. The miniaturized data processing device of claim 2 wherein said first and second surface portions are generally horizontal and flat.

* * * * *